US010438733B2

(12) United States Patent
Yoshida et al.

(10) Patent No.: US 10,438,733 B2
(45) Date of Patent: Oct. 8, 2019

(54) REACTOR HAVING FUNCTION OF PREVENTING ELECTRICAL SHOCK

(71) Applicant: FANUC CORPORATION, Minamitsuru-gun, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/046,334

(22) Filed: Jul. 26, 2018

(65) Prior Publication Data

US 2019/0035529 A1 Jan. 31, 2019

(30) Foreign Application Priority Data

Jul. 27, 2017 (JP) ..... 2017-145640

(51) Int. Cl.

| | |
|---|---|
| ***H01F 27/29*** | (2006.01) |
| ***H01F 27/02*** | (2006.01) |
| ***H01F 27/40*** | (2006.01) |
| ***H01F 27/24*** | (2006.01) |
| *H01F 37/00* | (2006.01) |

(Continued)

(52) U.S. Cl.

CPC ..... *H01F 27/02* (2013.01); *H01F 27/24* (2013.01); *H01F 27/29* (2013.01); *H01F 27/40* (2013.01); *H01F 37/00* (2013.01); *H01R 9/24* (2013.01); *H01R 13/447* (2013.01)

(58) Field of Classification Search

CPC ..... H01F 27/29

See application file for complete search history.

(56) References Cited

U.S. PATENT DOCUMENTS

| | | | | |
|---|---|---|---|---|
| 9,847,163 | B2 * | 12/2017 | Kozuru | H02B 11/04 |
| 2008/0197961 | A1 * | 8/2008 | Patel | H01F 21/12 336/170 |
| 2018/0254135 | A1 * | 9/2018 | Tsukada | H01F 27/025 |

(Continued)

FOREIGN PATENT DOCUMENTS

| | | | |
|---|---|---|---|
| CN | 201956188 | U | 8/2011 |
| CN | 105684246 | A | 6/2016 |

(Continued)

*Primary Examiner* — Elvin G Enad
*Assistant Examiner* — Malcolm Barnes
(74) *Attorney, Agent, or Firm* — RatnerPrestia

(57) ABSTRACT

A reactor includes a core body having an outer peripheral iron core, at least three iron cores contacting or coupled to an internal surface of the outer peripheral iron core, and coils wound on the iron cores. The reactor has a terminal base including terminals connected to the coils and connected to cables through current-carrying portions, and an electrical shock protection cover for covering the terminal base. The electrical shock protection cover includes a main portion for covering the current-carrying portions, and cable covering portions extending from the main portion to cable drawing directions so as to cover a part of each cable. The terminal base includes a main portion for supporting the current-carrying portions, and cable receiving portions in which passages are formed to pass the cables therethrough between the cable receiving portion and the cable covering portion.

6 Claims, 6 Drawing Sheets

(51) Int. Cl.
*H01R 9/24* (2006.01)
*H01R 13/447* (2006.01)

(56) References Cited

U.S. PATENT DOCUMENTS

| | | | | |
|---|---|---|---|---|
| 2019/0006092 | A1* | 1/2019 | Iizuka | H01F 17/04 |
| 2019/0035529 | A1 | 1/2019 | Yoshida et al. | |

FOREIGN PATENT DOCUMENTS

| | | | | |
|---|---|---|---|---|
| CN | 205319000 | U | | 6/2016 |
| CN | 208607991 | U | | 3/2019 |
| EP | 353137 | A1 | * | 1/1990 |
| JP | 04196113 | A | * | 7/1992 |
| JP | 2009-283706 | A | | 12/2009 |
| JP | 2009283706 | A | * | 12/2009 |
| JP | 6363750 | B1 | | 7/2018 |
| WO | 2017221648 | A1 | | 12/2017 |

* cited by examiner

REACTOR HAVING FUNCTION OF PREVENTING ELECTRICAL SHOCK

This application is a new U.S. patent application that claims benefit of JP 2017-145640 filed on Jul. 27, 2017, the content of JP 2017-145640 is incorporated herein by reference.

BACKGROUND OF THE INVENTION

1. Field of the Invention

The present invention relates to a reactor, and more specifically relates to a reactor having the function of preventing an electrical shock.

2. Description of Related Art

Alternating current (AC) reactors are used in order to reduce harmonic current occurring in inverters, etc., to improve input power factors, and to reduce inrush current to the inverters. Such an AC reactor has a core made of a magnetic material and a coil formed around the core.

Three-phase AC reactors each including three-phase coils (windings) arranged in a line are known (for example, Japanese Unexamined Patent Publication (Kokai) No. 2009-283706, hereinafter referred to as "Patent Document 1"). Patent Document 1 discloses a reactor in which each of three windings is connected to a pair of terminals at both ends, and the reactor is connected to another electrical circuit through the pairs of terminals.

In reactors, the cross-sectional area of cables to be used is sometimes designated in conformity with standards (for example, adhering or not adhering to the U.S. standards NFPA (National Fire Protection Association)). Taking the U.S. standards NFPA as an example, the cables have a larger cross-sectional area when adhering to the standards than when not adhering to the standards.

SUMMARY OF THE INVENTION

Since an electrical shock protection cover for a reactor terminal base is attached from the top of the terminal base, the cover is partly cut away to avoid the connected cables. Therefore, there is a problem that, although connecting cables of a large cross-sectional area to the terminal base prevents a finger from contacting current-carrying portions, connecting cables of a small cross-sectional area to the terminal base of the same size allows the finger to contact the current-carrying portions.

A reactor according to an embodiment of the present disclosure includes a core body. The core body includes an outer peripheral iron core, at least three iron cores disposed so as to contact or be coupled to an internal surface of the outer peripheral iron core, and coils wound on the iron cores. In the reactor, a gap is formed between one of the iron cores and another of the iron cores adjacent to the one of the iron cores, so as to be magnetically connectable through the gap. Furthermore, the reactor has a terminal base including a terminal that is connected to the coil and configured to be connected to a cable through a current-carrying portion, and an electrical shock protection cover disposed so as to cover the terminal base. The electrical shock protection cover includes a main portion for covering the current-carrying portion, and a cable covering portion that extends from the main portion to a cable drawing direction and is configured to cover a part of the cable connected to the terminal. The terminal base has a main portion for supporting the current-carrying portion, and a cable receiving portion extending from the main portion to the cable drawing direction so as to form a passage to pass the cable between the cable receiving portion and the cable covering portion.

BRIEF DESCRIPTION OF THE DRAWINGS

The objects, features, and advantages of the present invention will be more apparent from the following description of embodiments with reference to the accompanying drawings. In the drawings.

DETAILED DESCRIPTION OF THE INVENTION

Figure 1A:
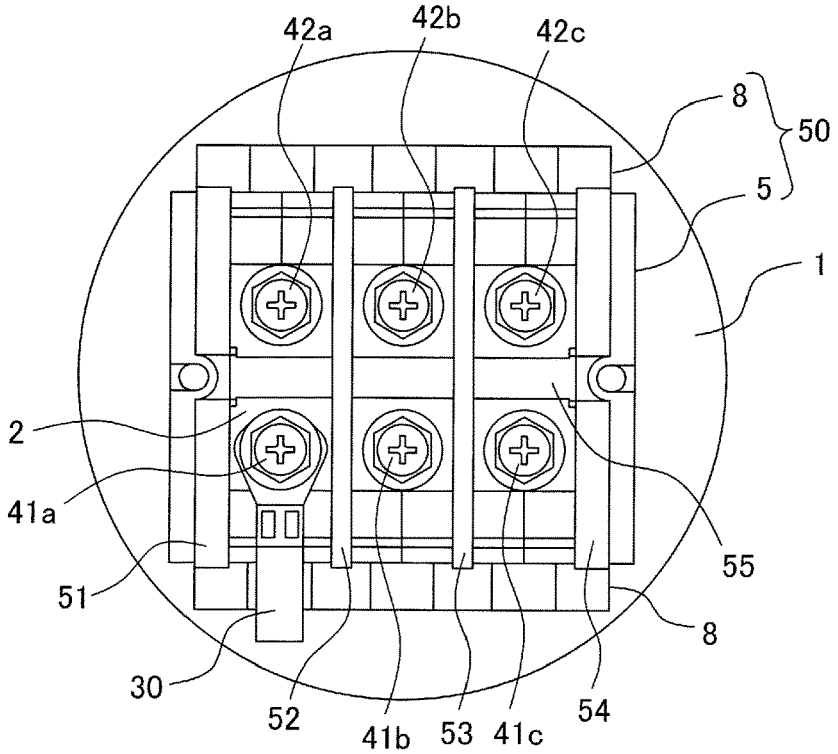
FIG. 1A is a plan view of a reactor according to a first embodiment, including a terminal base to which a thick cable is connected.

Embodiments of the present invention will be described below with reference to the accompanying drawings. In the drawings, the same reference numerals indicate the same components. For ease of understanding, the scales of the drawings are modified in an appropriate manner.

The following description mainly describes a three-phase reactor as an example. However, the present disclosure is not limited to three-phase reactors but can be widely applied to any multi-phase reactor that requires constant inductance in each phase. The reactor according to the present disclosure can be applied to various types of equipment, as well as applied to the primary sides and secondary sides of the inverters in industrial robots and machine tools.

Figure 1B:
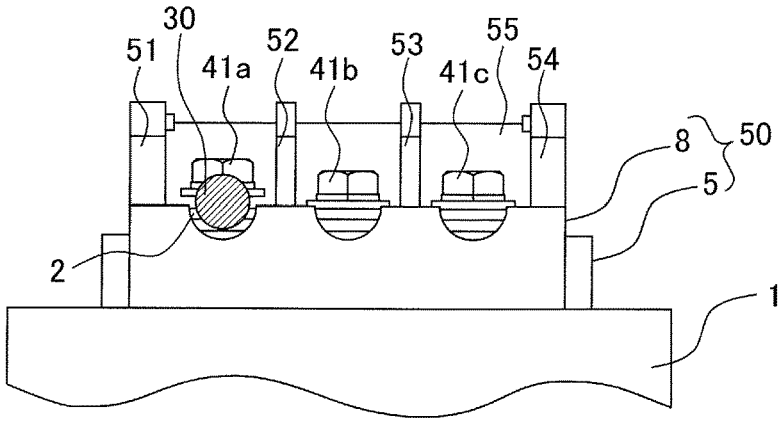
FIG. 1B is a side view of the reactor according to the first embodiment, including the terminal base to which the thick cable is connected.

A reactor according to a first embodiment will be described. FIG. 1A is a plan view of the reactor according to the first embodiment, including a terminal base to which a thick cable (having large cross-sectional area) is connected. FIG. 1B is a side view of the reactor including the terminal base to which the thick cable is connected. The thick cable is used when adhering to, for example, U.S. standards (NFPA). In this embodiment, applicable cables to be connected to the terminal base are already known as standards. The reactor according to the first embodiment includes a core body 1. The core body 1 includes an outer peripheral iron core (not shown), at least three iron cores (not shown) disposed so as to contact or be coupled to an internal surface of the outer peripheral iron core, and coils (not shown) wound on the iron cores. A gap is formed between one of the iron cores and another of the iron cores adjacent to the one of the iron cores, so as to be magnetically connectable through the gap. A terminal base main portion 5 has terminals (41*a* to 41*c*, and 42*a* to 42*c*) that are connected to the coils, and each configured to be connected to a cable 30 through a current-carrying portion 2.

In the example of FIG. 1A, a terminal base 50 includes the six terminals (41*a* to 41*c*, and 42*a* to 42*c*). For example, the terminals 41*a* to 41*c* may be input terminals, and the terminals 42*a* to 42*c* may be output terminals. The terminals 41*a* and 42*a* may be R-phase terminals. The terminals 41*b* and 42*b* may be S-phase terminals. The terminals 41*c* and 42*c* may be T-phase terminals. However, the present invention is not limited to this example.

Each of the terminals (41*a* to 41*c*, and 42*a* to 42*c*) is connected to the cable 30 through the current-carrying portion 2. The terminals (41*a* to 41*c*, and 42*a* to 42*c*) and the current-carrying portions 2 are insulated by sidewalls 51 to 55. In the following, description regarding the core body 1 is omitted.

Figure 2A:
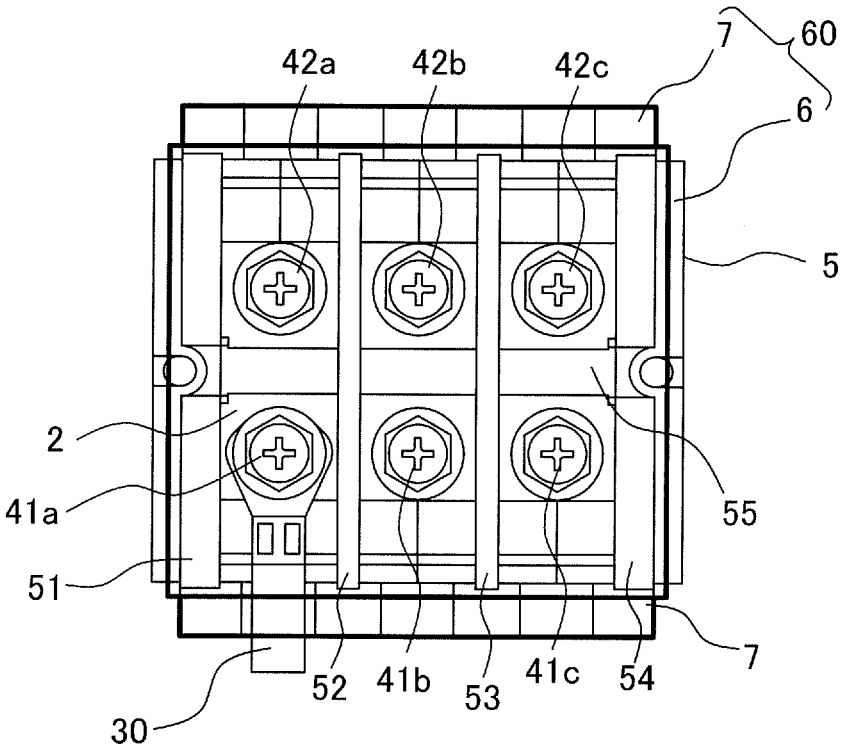
FIG. 2A is a plan view of the terminal base included in the reactor according to the first embodiment, in which the thick cable is connected to the terminal base covered with an electrical shock protection cover.
Figure 2B:
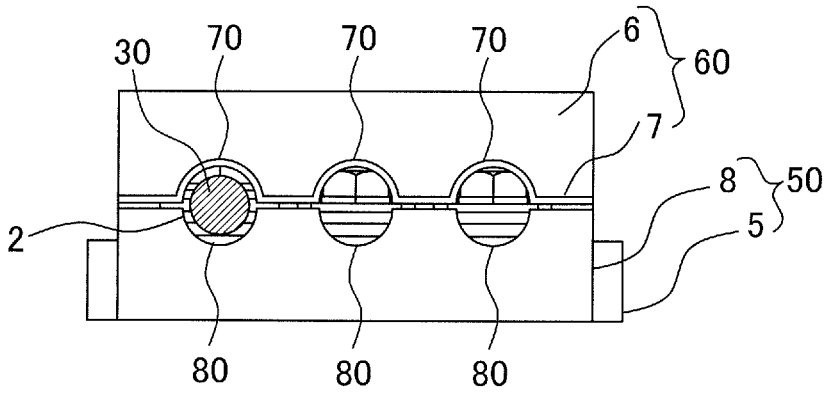
FIG. 2B is a side view of the terminal base included in the reactor according to the first embodiment, in which the thick cable is connected to the terminal base covered with the electrical shock protection cover.

FIG. 2A is a plan view of the terminal base included in the reactor according to the first embodiment, in which the thick cable is connected to the terminal base covered with an electrical shock protection cover. FIG. 2B is a side view of the terminal base included in the reactor according to the first embodiment, in which the thick cable is connected to the terminal base covered with the electrical shock protection cover. The electrical shock protection cover 60 is disposed so as to cover the terminal base 50. Since the electrical shock protection cover 60 covers the terminals (41*a* to 41*c*, and 42*a* to 42*c*) and the current-carrying portions 2, it is possible to prevent a finger from touching the terminal base 50 from above and receiving an electrical shock.

As shown in FIG. 2B, the electrical shock protection cover 60 has a main portion 6 for covering the current-carrying portions 2, and cable covering portions 7 that extend from the main portion 6 to cable drawing directions so as to cover a part of the cable 30 connected to the terminal 41*a*. As shown in FIG. 2B, when the thick cable 30 is connected to the terminal 41*a*, no clearance of a size so as to allow a finger to get in the current-carrying portion 2 is formed.

As shown in FIGS. 2A and 2B, the terminal base 50 includes the terminal base main portion 5, and cable receiving portions 8 that extend from the terminal base main portion 5 to the cable drawing directions so as to form passages each of which passes the cable 30 between the cable receiving portion 8 and the cable covering portion 7.

The cable covering portions 7 preferably have recessed grooves 70 formed along the cable drawing directions. The cable receiving portions 8 preferably have recessed grooves 80 formed along the cable drawing directions. The recessed grooves 70 of the cable covering portions 7 and the recessed grooves 80 of the cable receiving portions 8 form the passages that conform to the cross-sectional shape of the cable 30. The cross-sections of the passages are preferably similar in shape to the cross-section of an applicable cable to be connected to the terminal base.

Figure 3A:
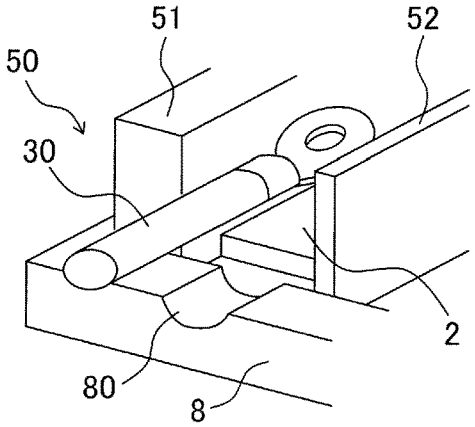
FIG. 3A is a perspective view of the terminal base included in the reactor according to the first embodiment, showing a state before the thick cable is connected to the terminal base.

FIG. 3A is a perspective view of the terminal base included in the reactor according to the first embodiment, showing a state before the thick cable is connected to the terminal base. The current-carrying portion 2 is provided between the sidewalls 51 and 52 of the terminal base 50, and a terminal of the cable 30 is connected to the current-carrying portion 2. The recessed groove 80 is formed in the cable receiving portion 8 of the terminal base 50 so as to conform to the shape of the thick cable 30.

Figure 3B:
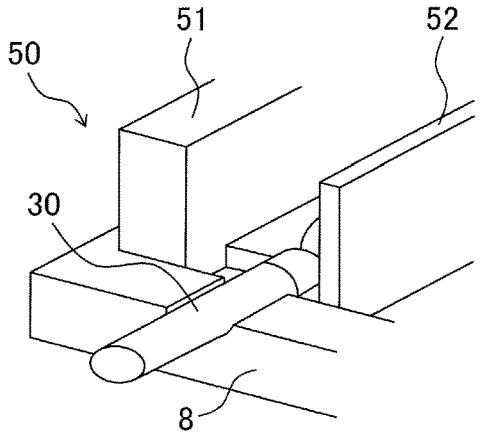
FIG. 3B is a perspective view of the terminal base included in the reactor according to the first embodiment, showing a state after the thick cable is connected to the terminal base.

FIG. 3B is a perspective view of the terminal base included in the reactor according to the first embodiment, showing a state after the thick cable is connected to the terminal base. The thick cable 30 is disposed at its lower half in the recessed groove 80 formed in the cable receiving portion 8 of the terminal base 50.

Figure 3C:
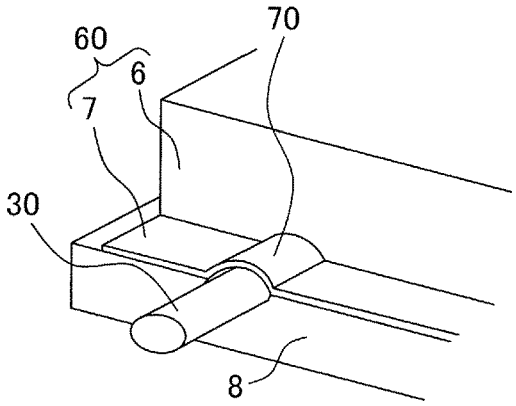
FIG. 3C is a perspective view of the terminal base included in the reactor according to the first embodiment, showing a state after the terminal base is covered with the electrical shock protection cover.

FIG. 3C is a perspective view of the terminal base included in the reactor according to the first embodiment, showing a state after the terminal base is covered with the electrical shock protection cover. The main portion 6 of the electrical shock protection cover 60 is disposed so as to cover the main portion of the terminal base 50. The recessed groove 70 formed in the cable covering portion 7 of the electrical shock protection cover 60 is disposed opposite the recessed groove 80 formed in the cable receiving portion 8, so as to cover the thick cable 30 at its upper half.

Figure 4A:
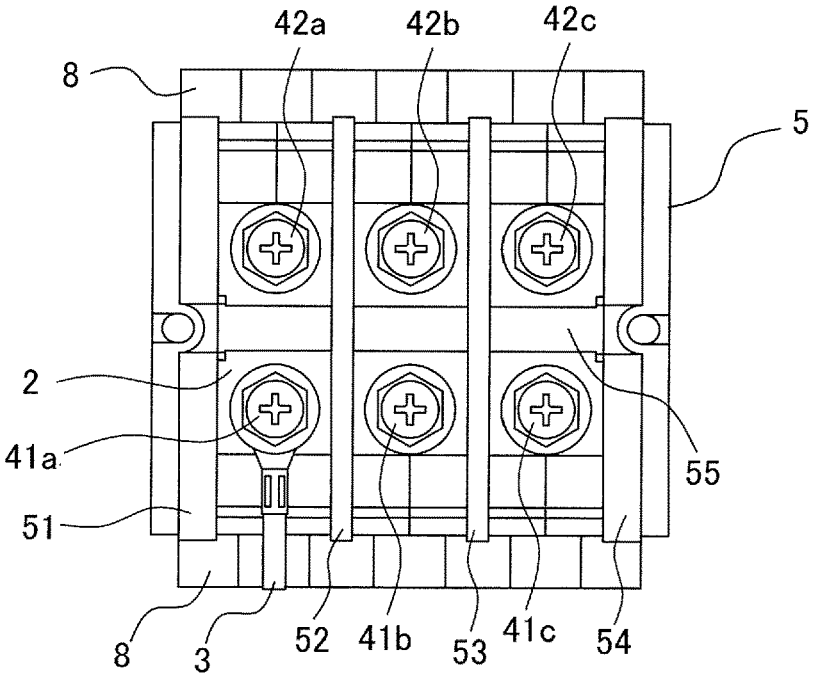
FIG. 4A is a plan view of the terminal base included in the reactor according to the first embodiment, in which a thin cable is connected to the terminal base.
Figure 4B:
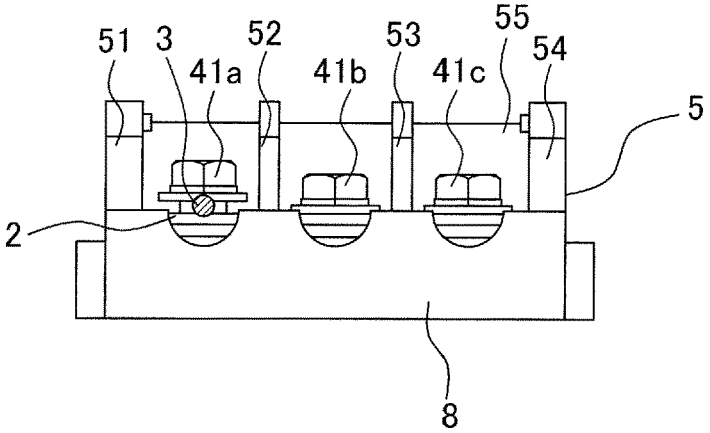
FIG. 4B is a side view of the terminal base included in the reactor according to the first embodiment, in which the thin cable is connected to the terminal base.

FIG. 4A is a plan view of the terminal base included in the reactor according to the first embodiment, in which a thin cable (having a small cross-sectional area) is connected to the terminal base. FIG. 4B is a side view of the terminal base included in the reactor according to the first embodiment, in which the thin cable is connected to the terminal base. A cable 3 shown in FIGS. 4A and 4B is thinner than the cable 30 shown in FIGS. 1A and 1B. The thin cable is used, when not adhering to, for example, the U.S. standards (NFPA).

Figure 5A:
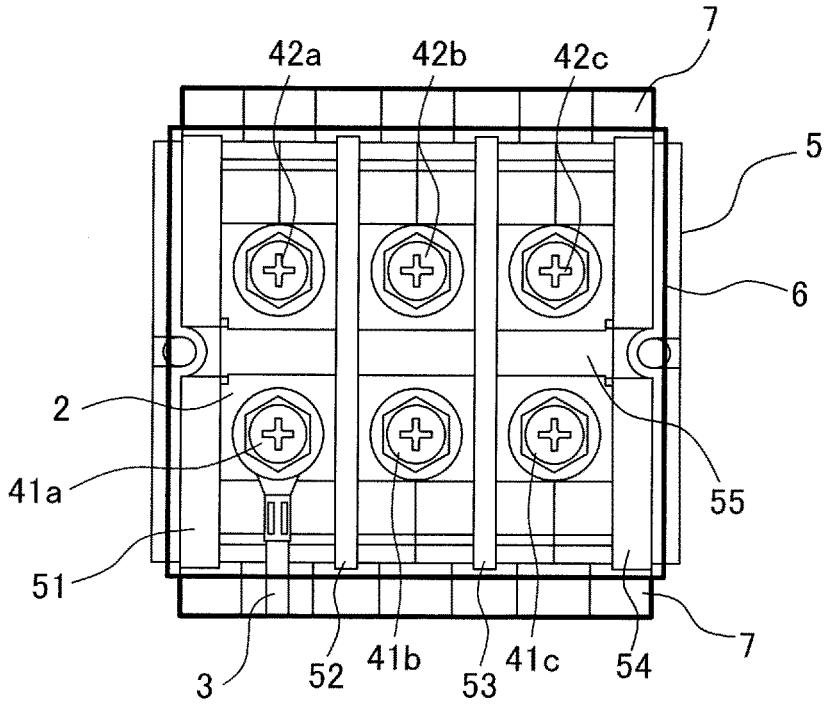
FIG. 5A is a plan view of the terminal base included in the reactor according to the first embodiment, in which the thin cable is connected to the terminal base covered with the electrical shock protection cover.
Figure 5B:
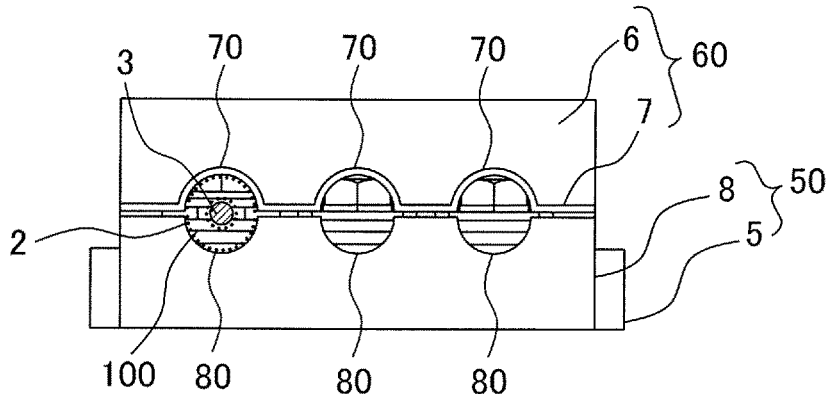
FIG. 5B is a side view of the terminal base included in the reactor according to the first embodiment, in which the thin cable is connected to the terminal base covered with the electrical shock protection cover.

FIG. 5A is a plan view of the terminal base included in the reactor according to the first embodiment, in which the thin cable is connected to the terminal base covered with the electrical shock protection cover. FIG. 5B is a side view of the terminal base included in the reactor according to the first embodiment, in which the thin cable is connected to the terminal base covered with the electrical shock protection cover. The cable 3 shown in FIGS. 5A and 5B is thinner than the cable 30 shown in FIGS. 2A and 2B. As shown in FIG. 5B, the recessed groove 70 formed in the cable covering portion 7 of the electrical shock protection cover 60 and the recessed groove 80 formed in the cable receiving portion 8 of the terminal base 50 form a passage through which the thin cable 3 passes, and a clearance 100 is formed around the thin cable 3. However, since the clearance is of a size which does not to allow a finger to enter therein, the finger is prevented from touching the current-carrying portion.

Next, a reactor according to a second embodiment will be described. The difference between the reactor according to the second embodiment and the reactor according to the first embodiment is that at least one of the cable covering portion 7 and the cable receiving portion 8 is provided with contractable members (71 or 81), so as to fill at least a part of the clearance formed between a cable and the cable covering portion. The other structures of the reactor according to the second embodiment are the same as those of the reactor according to first embodiment, so a detailed description thereof is omitted.

Figure 6:
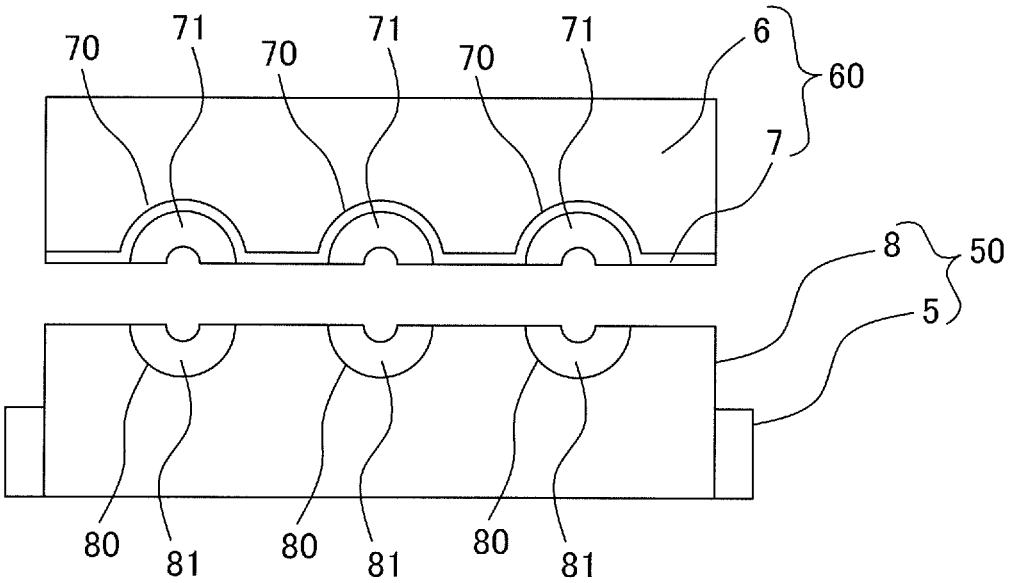
FIG. 6 is a side view of a terminal base and an electrical shock protection cover of a reactor according to a second embodiment.

FIG. 6 is a side view of the terminal base and the electrical shock protection cover of the reactor according to the second embodiment. As shown in FIG. 6, the cable covering portion 7 is provided with contractable members 71 each of which fills at least a part of the clearance formed between a cable and the cable covering portion 7. The cable receiving portion 8 is provided with contractable members 81 each of which fills at least a part of the clearance formed between a cable and the cable receiving portion 8. However, not limited to this example, only the cable covering portion 7 may be provided with the contractable members 71. Alternatively, only the cable receiving portion 8 may be provided with the contractable members 81. As described in the reactor according to the second embodiment, the provided contractable members (71 and 81) fill at least a part of the clearance formed between the cable and its passage, irrespective of the thickness of the cable. As a result, it is possible to further reduce the risk that a finger touches the current-carrying portion 2.

As described above, according to the reactor of this embodiment, it is possible to prevent contact with the current-carrying portion of the terminal base, irrespective of the thickness of a cable connected to the terminal base of the reactor. As a result, the reactor can conform to the IP code IP2X (protection for a solid object: protection for a solid object having a diameter of 12 mm (12.5 mm) or more, e.g., a finger), irrespective of the thickness of the cable.

According to the reactor of the embodiments of the present disclosure, it is possible to prevent contact with the current-carrying portion of the terminal base, irrespective of the thickness of a cable connected to the terminal base of the reactor.

What is claimed is:

1. A reactor comprising:

a core body including an outer peripheral iron core, at least three iron cores disposed so as to contact or be coupled to an internal surface of the outer peripheral iron core, and coils wound on the iron cores;

a gap formed between one of the iron cores and another of the iron cores adjacent to the one of the iron cores, so as to be magnetically connectable through the gap;

a terminal base including a terminal connected to the coil, the terminal being configured to be connected to a cable through a current-carrying portion; and an electrical shock protection cover disposed so as to cover the terminal base, wherein the electrical shock protection cover includes a main portion for covering the current-carrying portion, and a cable covering portion extending from the main portion to a cable drawing direction, the cable covering portion being configured to cover a part of the cable connected to the terminal, wherein the cable covering portion includes recessed grooves along the cable drawing direction, and wherein the terminal base has a terminal base main portion for supporting the current-carrying portion, and a cable receiving portion extending from the terminal base main portion to the cable drawing direction, the cable receiving portion forming a passage to pass the cable between the cable receiving portion and the cable covering portion.

2. The reactor according to claim 1, wherein the cable covering portion is provided with a contractable member so as to fill at least a part of a clearance formed between the cable and the cable covering portion.

3. The reactor according to claim 1, wherein the cable receiving portion is provided with a contractable member so as to fill at least a part of a clearance formed between the cable and the cable receiving portion.

4. The reactor according to claim 1, wherein the cable covering portion has a recessed groove formed along the cable drawing direction.

5. The reactor according to claim 1, wherein the cable receiving portion has a recessed groove formed along the cable drawing direction.

6. The reactor according to claim 1, wherein the cross-section of the passage is similar in shape to the cross-section of an applicable cable to be connected to the terminal base.

* * * * *